US006978114B2

(12) United States Patent
Okamoto et al.

(10) Patent No.: US 6,978,114 B2
(45) Date of Patent: Dec. 20, 2005

(54) IMAGE FORMING DEVICE WITH MULTIPLE TRAYS

(75) Inventors: Yoshinari Okamoto, Toyoake (JP); Shohei Tsujimoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/745,543

(22) Filed: Dec. 29, 2003

(65) Prior Publication Data

US 2004/0141762 A1 Jul. 22, 2004

(30) Foreign Application Priority Data

Jan. 6, 2003 (JP) ..... 2003-000575

(51) Int. Cl.[7] ..... G03G 15/00; B65H 1/00

(52) U.S. Cl. ..... 399/389; 399/23; 399/45; 399/82; 271/171

(58) Field of Search ..... 399/389, 82, 23, 399/45; 271/171

(56) References Cited

U.S. PATENT DOCUMENTS

| | | | | |
|---|---|---|---|---|
| 5,826,156 | A * | 10/1998 | Natsume et al. | 399/389 |
| 5,864,732 | A * | 1/1999 | Kato | 399/43 |
| 6,393,252 | B1 * | 5/2002 | Yamagishi | 399/401 |
| 6,606,466 | B2 * | 8/2003 | Sato | 399/82 |
| 2002/0118975 | A1 * | 8/2002 | Asai | 399/45 |

FOREIGN PATENT DOCUMENTS

| | | |
|---|---|---|
| JP | A 6-247000 | 9/1994 |
| JP | A 11-157681 | 6/1999 |
| JP | A 11-174908 | 7/1999 |

* cited by examiner

*Primary Examiner*—Andrew H. Hirshfeld
*Assistant Examiner*—Marvin P. Crenshaw
(74) *Attorney, Agent, or Firm*—Oliff & Berridge, PLC

(57) ABSTRACT

When operating in a photocopier mode a first tray is first selected, and a second tray is then selected if there is no recording medium in the first tray. If recording medium is in the second tray but the size of the recording medium is not the same as the size of the recording medium loaded to the first tray, a notice indicating a size change is presented and recording is completed only if the user approves the size change using an operating panel.

8 Claims, 5 Drawing Sheets

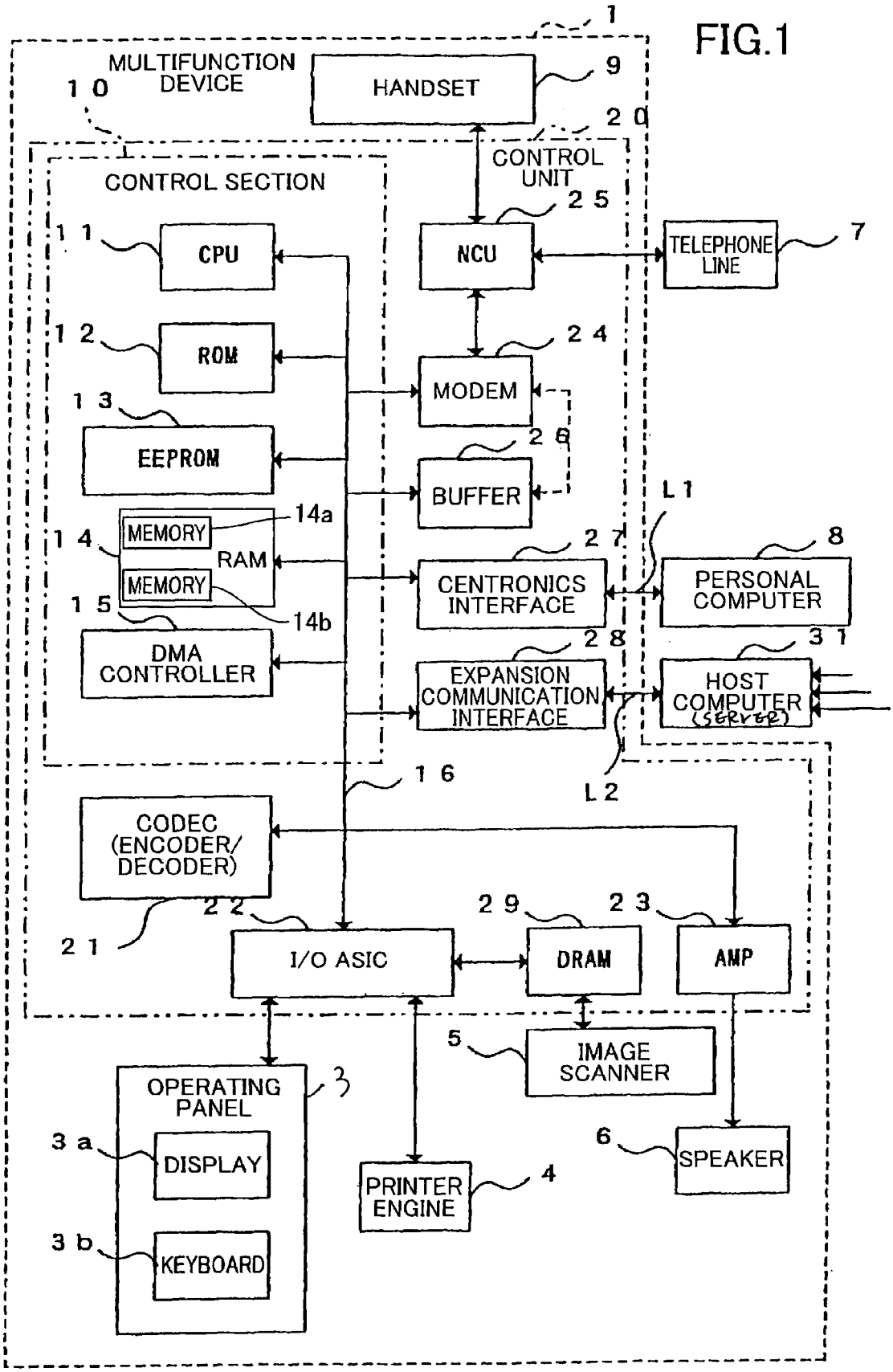
FIG.1
1
MULTIFUNCTION DEVICE
10
HANDSET
9
20
CONTROL UNIT
CONTROL SECTION
25
11
CPU
NCU
TELEPHONE LINE
7
12
ROM
24
MODEM
13
EEPROM
26
BUFFER
L1
14a
14
MEMORY
RAM
MEMORY
14b
27
CENTRONICS INTERFACE
8
PERSONAL COMPUTER
15
DMA CONTROLLER
28
EXPANSION COMMUNICATION INTERFACE
31
HOST COMPUTER (SERVER)
16
L2
CODEC (ENCODER/ DECODER)
21
22
I/O ASIC
29
DRAM
23
AMP
5
IMAGE SCANNER
OPERATING PANEL
3
3a
DISPLAY
3b
KEYBOARD
PRINTER ENGINE
4
6
SPEAKER

IMAGE FORMING DEVICE WITH MULTIPLE TRAYS

BACKGROUND OF THE INVENTION

1. Field of the Invention

The present invention relates to an image forming device for forming images on a recording medium, and more particularly to an image forming device that includes multiple trays, selects one of the multiple trays, and forms images on a recording medium stored in the selected tray.

2. Related Art

A conventional image forming device has a printing means for forming an image on a recording medium, multiple trays for storing recording medium, a selection means for selecting one of the multiple trays, and transportation means for carrying a recording medium stored in the selected tray to the printing means. The printing means forms an image on the recording medium supplied from the selected tray.

One type of such a selection means automatically selects one of multiple trays that holds the appropriate size of recording sheet. For example, a laser printer disclosed in Japanese Patent-Application Publication No. HEI-11-157681 automatically selects a tray that holds the size of sheet appropriate to image data received from a host computer, and a photocopier disclosed in Japanese Patent-Application Publication No. HEI-11-174908 automatically selects a tray that corresponds to a document size detected by sensors. Various sizes of recording sheet, including metric and US paper sizes, can be used in the photocopier of Japanese Patent-Application Publication No. HEI-11-174908.

The tray selected by the selection means of these image forming devices could be empty. However, Japanese Patent-Application Publication No. HEI-11-174908 discloses nothing about what to do when there is no recording sheet in the selected tray. In the laser printer of Japanese Patent-Application Publication No. HEI-11-157681, when there is no recording sheet in the initially selected tray, a different tray is selected. Then, if the newly selected tray contains the same size of recording sheet, a recording sheet is fed from the newly selected tray. However, if the same size of recording sheet is not held in the newly selected tray, then printing operation is halt, and the user is prompted to load the same size of recording sheet into the tray. That is, the same size of recording sheet must be stored in each tray.

However, storing the same size of recording sheet in each tray is not very useful for an image forming device that handles documents and image data of various sizes. Furthermore, depending on how the image forming device is used (that is, for a functional purpose, such as receiving faxes, photocopying, or printing data from a personal computer, or a task-oriented purpose, such as a final copy or test print), it may be desirable to use a different size of recording sheet than is first selected. This applies not only to the sheet size, but also the type of recording sheet (such as bond paper, OHP film, or special-purpose paper, and various paper thicknesses).

SUMMARY OF THE INVENTION

Therefore, it is preferable that an image forming device store a recording sheet in one tray and different size and/or type of recording sheet in other tray, and that printing is performed on the recording sheet in the other tray if the recording sheet in the other tray could be used in place of the recording sheet in initially selected tray when the initially selected tray is empty.

Further, it is desirable that a multifunction device, which provides multiple functions, such as a facsimile function, photocopier function, and printer function, in a single unit, switch its operation according to the function of the device when a selected tray is empty.

In the view of foregoing, it is an object of the present invention to overcome the above problems, and also to provide an image forming device that selects one of multiple trays and forms an image on a recording medium supplied from the selected tray, and that can appropriately form images even when no recording medium is stored in initially selected tray.

In order to achieve the above and other objects, there is provided an image forming device including a printing unit that forms an image on a recording medium, a plurality of trays, each supporting a recording medium, a selection unit that selects one of the plurality of trays, a supply unit that supplies a recording medium from the selected one of the plurality of trays to the printing unit, a detecting unit that detects whether the selected one of the plurality of trays is empty, a controller that instructs the selection unit to reselect a different one of the plurality pf trays when the detecting unit detects that the selected one of the plurality of trays is empty, a determining unit that determines whether one or more of size and type of recording medium for the selected one of the plurality of trays differs from one or more of size and type of recording medium stored in the selected different one of the plurality of trays, a notifying unit that notifies a user of information relating to the selected different one of the plurality of trays when the determining unit determines that one or more of size and type of recording medium for the selected one of the plurality of trays differs from one or more of size and type of recording medium stored in the selected different one of the plurality of trays, and an input unit through which an approval is input. The approval approves using the selected different one of the plurality of trays. When the approval is input, the supply unit supplies the recording medium from the selected different one of the plurality of trays to the printing unit.

There is also provided an image forming device including a printing unit that forms an image on a recording medium, a plurality of trays, each holding a recording medium, a selection unit that selects one of the plurality of trays, a supply unit that supplies a recording medium from the selected one of the plurality of trays to the printing unit, a scanning unit that reads a document image from a document, a receiving unit that receives image data, a detecting unit that detects whether the selected one of the plurality of trays is empty, and a controller that controls the printing unit and the supply unit. When the detecting unit detects that the selected one of the plurality of trays is empty, the controller differently controls one or more of the printing unit and the supply unit between when the printing unit forms an image based on the document image and when the printing unit forms an image based on the image data received by the receiving unit.

BRIEF DESCRIPTION OF THE DRAWINGS

In the drawings:

FIG. 1 is a schematic block diagram of a multifunction device according to an embodiment of the present invention;

PREFERRED EMBODIMENT OF THE PRESENT INVENTION

Figure 2:
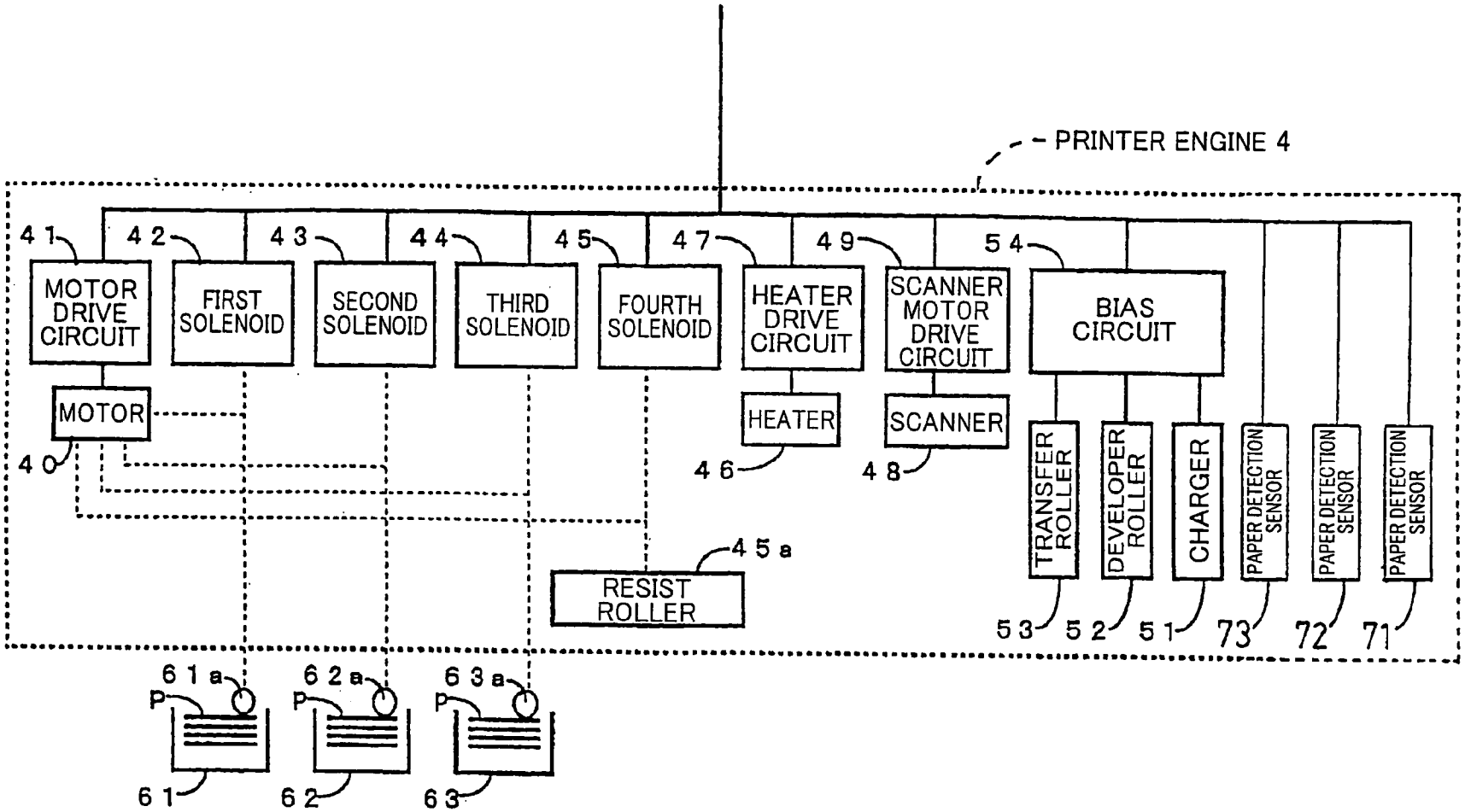
FIG. 2 is a block diagram of a printer engine of the multifunction device of FIG. 1.

A preferred embodiment of the present invention will be described with reference to the accompanying drawings. In the embodiment described below, the present invention is applied to a multifunction device 1 shown in FIG. 1. The multifunction device 1 includes a normal facsimile function and is connected to an external personal computer 8 and a network via connector cables L1, L2 (described below), respectively. The facsimile function prints images onto a recording sheet P (FIG. 2) based on image data received over a telephone line 7 and sends image data scanned from a document over the telephone line 7.

As shown in FIG. 1, the multifunction device 1 includes a control unit 20, an operating panel 3, a printer engine 4, an image scanner 5, a speaker 6, and a handset 9. The operating panel 3, the printer engine 4, the image scanner 5, and the speaker 6, and the handset 9 are all connected to the control unit 20. The operating panel 3 includes a display 3*a* and a keyboard 3*b*. The speaker 6 is for outputting sound including audio prompts.

The control unit 20 includes a control section 10, which includes a central processing unit (CPU) 11, a read only memory (ROM) 12, an electrically erasable and programmable ROM (EEPROM) 13, a random access memory (RAM) 14, and a direct memory access (DMA) controller 15, all connected to one another via a common bus 16, which includes a data bus. The common bus 16 is also connected to a CODEC 21 and an input/output application specific integrated circuit (I/O ASIC) 22. The CODEC 21 has an encoder for coding (compressing) image data and a decoder for decoding coded (compressed) communication data. The I/O ASIC 22 includes hard logic circuits.

The common bus 16 is further connected to an audio amplifier (AMP) 23, a modem 24, a buffer 26, a Centronics-compatible communication interface 27, and an expansion communication interface 28. The AMP 23 is for driving the speaker 6. The modem 24 is for facsimile communication as well as voice and audio communication. The Centronics-compatible communication interface 27 is for connection with the personal computer 8 via the connector cable L1. The expansion communication interface 28 is for connecting through the connector cable L2 with a host computer (server) 31 on a local area network (LAN).

The connector cable L1 is a Centronics cable for connecting the Centronics communication interface 27 with a Centronics communication interface of the personal computer 8. To enable parallel data communication, the connector cable L1 has plural data lines (such as eight data lines for 8-bit communication) and signal lines. One of the plural signal lines is for a power supply status signal denoting the supply voltage state of the personal computer 8.

The modem 24 is connected to a network control unit (NCU) 25. The NCU 25 is in turn connected to the telephone line 7 and the handset 9. The operating panel 3 and the printer engine 4 are connected to the I/O ASIC 22. The image scanner 5 is connected to the I/O ASIC 22 through a DRAM 29. Image data captured by the image scanner 5 is stored temporarily to the DRAM 29 and read from the DRAM 29 by the I/O ASIC 22.

The I/O ASIC 22 processes parallel data supplied from the communication interfaces 27 and 28 via the common bus 16 by hard logic, and outputs the result to the printer engine 4. The I/O ASIC 22 is provided with a plurality of input/output (I/O) ports, and the power supply status signal supplied on the signal line of the connector cable L1 is applied to a specific I/O port. This enables the CPU 11 to detect, based on the status signal applied to the specific I/O port, whether or not the power supply of the personal computer 8 has shut down.

The ROM 12 stores a facsimile control program, a photocopier control program, a printer control program, and a scanner control program. The facsimile control program is for facsimile receiving operation whereby image data (facsimile data) is received from an external facsimile machine. (not shown in the drawings) via the telephone line 7 and printed on a recording sheet P by the printer engine 4, and for facsimile sending operation whereby the image data is captured by the image scanner 5 and then sent to an external facsimile machine over the telephone line 7. The photocopier control program is for photocopier operation whereby image data is captured from an original document by the image scanner 5 and printed on a recording sheet P. The printer control program is for printer operation whereby image data is received from the personal computer 8 and printed on a recording sheet P. The scanner control program is for a scanner operation whereby image data is captured from a document by the image scanner 5 and sent to the personal computer 8.

The ROM 12 also stores a control program enabling receive-to-memory operation whereby image data received over the telephone line 7 is printed on a recording sheet P while being stored to a reception data memory (not shown) in the RAM 14; a control program enabling a telephone function for communicating voice signals with another party via the telephone line 7; a control program enabling an audio output function for outputting audio information received via the telephone line 7 and the communication interfaces 27, 28 through the speaker 6; and a control program for executing a general printing process (described later).

The CPU 11 is connected to a clock (not shown) and handles timer interrupts input from an internal timer that counts clock signals from the clock in hardware; When processing plural control programs in parallel, such as when processing the facsimile control program to send facsimile data and the printer control program in parallel, each time an approximately 1/60 second (approximately 16 msec) timer interrupt is received, the CPU 11 sequentially switches the programs for parallel processing on a time-share basis every approximately 1/60 second allocated to each of the control programs, thereby simultaneously executing multiple operations.

The EEPROM 13 stores, for example, settings for the facsimile sending and facsimile receiving operations, settings relating to the printing position and print density when operating in the printer mode, and telephone numbers for multiple parties. Information stored in the EEPROM 13 can be changed.

The RAM 14 includes a memory 14*a* for temporarily storing received image data and sound information, a memory 14*b* for storing the size of recording sheets P loaded respectively in a first tray 61 and a second tray 62 (FIG. 2), and various types of memory and buffers required to run the control programs for the facsimile receiving operation, the photocopier operation, and other functions.

Next, a configuration of the printer engine 4 will be described with reference to FIG. 2. As shown in FIG. 2, the printer engine 4 includes a motor 40, a motor drive circuit 41, a first solenoid 42, a second solenoid 43, a third solenoid 44, a fourth solenoid 45, a fusing heater 46, a heater drive circuit 47, a scanner 48, a scanner motor drive circuit 49, and a bias circuit 54.

The motor 40 is for driving the photosensitive drum (not shown) and rollers (described later). The I/O ASIC 22 outputs a drive signal to the motor 40 through the motor drive circuit 41. In addition to the motor drive circuit 41, I/O ASIC 22 is also connected to the solenoids 42–45, the heater drive circuit 47, the scanner motor drive circuit 49, and the bias circuit 54. The heater drive circuit 47 is for driving the fusing heater 46, and the scanner motor drive circuit 49 is for driving the scanner 48 to expose the photosensitive drum.

The printer engine 4 further includes a charger 51, a developer roller 52, and a transfer roller 53. The charger 51 is for uniformly charging the photosensitive drum, and the developer roller 52 is for developing an electrostatic latent image on the photosensitive drum with toner. The transfer roller 53 is for transferring the toner image onto a recording sheet P. The bias circuit 54 applies a respectively appropriate bias voltage to the charger 51, the developer roller 52, and the transfer roller 53.

The first solenoid 42 intermittently transfers drive power from the motor 40 to a supply roller 61*a* of the first tray 61. The second solenoid 43 similarly transfers drive power from the motor 40 to a supply roller 62*a* of the second tray 62. The third solenoid 44 transfers drive power from the motor 40 to a supply roller 63*a* of a multipurpose tray 63, and the fourth solenoid 45 transfers drive power from the motor 40 to a resist roller 45*a*.

Figure 3:
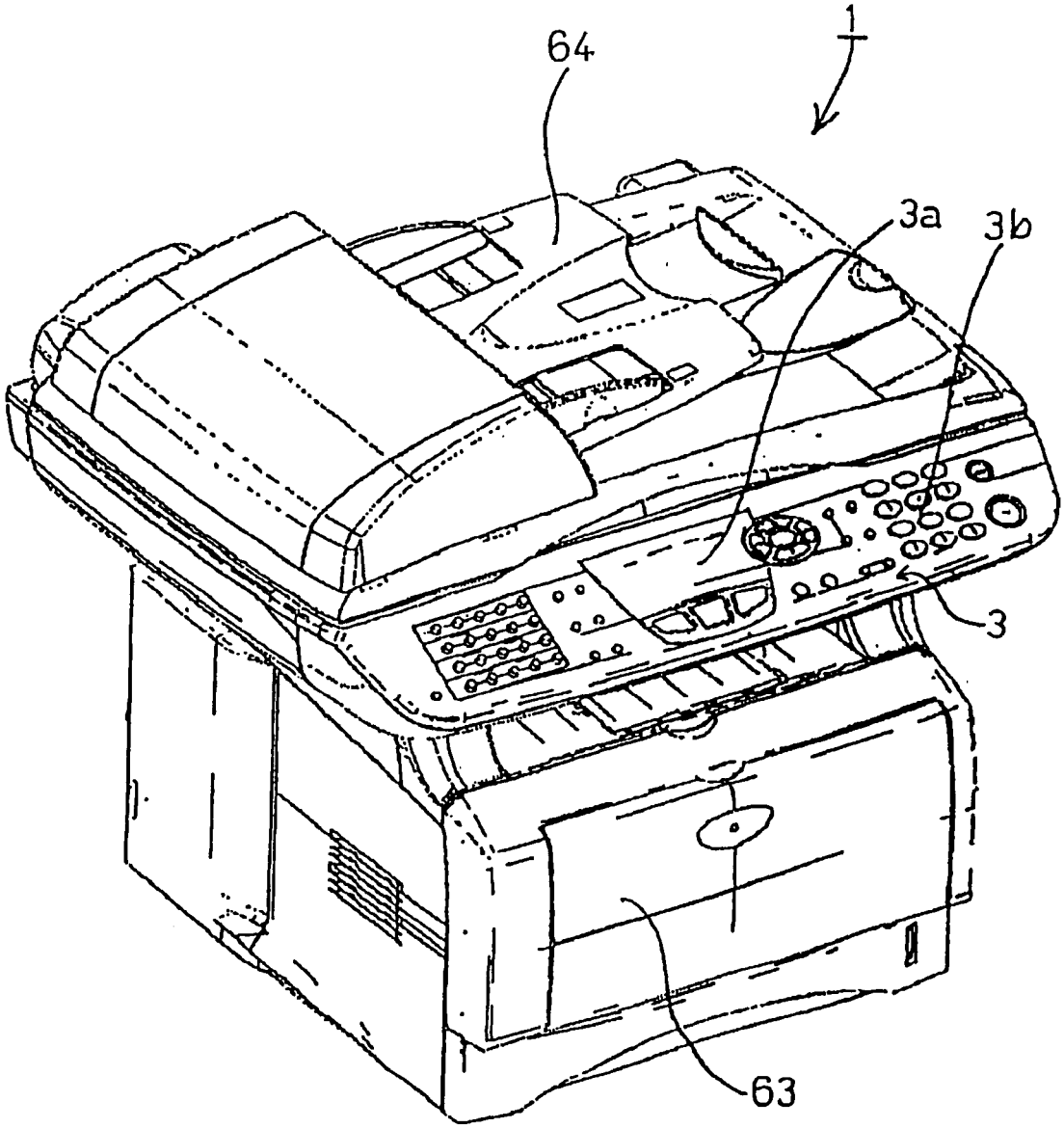
FIG. 3 is an external perspective view of the multifunction device of FIG. 1.

As shown in FIG. 3, the multifunction device 1 has the multipurpose tray 63. The multipurpose tray 63 is opened to load a stack of up to approximately 100 recording sheets P of a desired size for supply to a printing section. The memory 14*b* does not have an area for storing the size of recording sheets P loaded in the multipurpose tray 63 because the multipurpose tray 63 might hold different sizes of recording sheets at different times.

A document table 64 is disposed to the top of the multifunction device 1 for holding documents to be faxed or copied. The operating panel 3 is disposed at the front, the same side as the multipurpose tray 63. A user can input correlation between the sheet size and the first tray 61 and the second tray 62 through operation on the operating panel 3, and correlation data is stored in the memory 14*b*. Sheet detection sensors 71, 72, 73 (FIG. 2) for detecting if recording sheet P is loaded are also disposed to the first tray 61, the second tray 62, and the multipurpose tray 63, respectively.

Next, a process executed in the multifunction device 1 will be described with reference to the flowcharts shown in FIGS. 4 and 5. In this process, one of the trays 61 to 63 is automatically selected based on the correlation data stored in the memory 14*b*, and printing is performed. Here, the CPU 11 executes the process when automatic tray selection is being set and a printing command is received from the operating panel 3, the telephone line 7, the personal computer 8, or the host computer 31.

Figure 4:
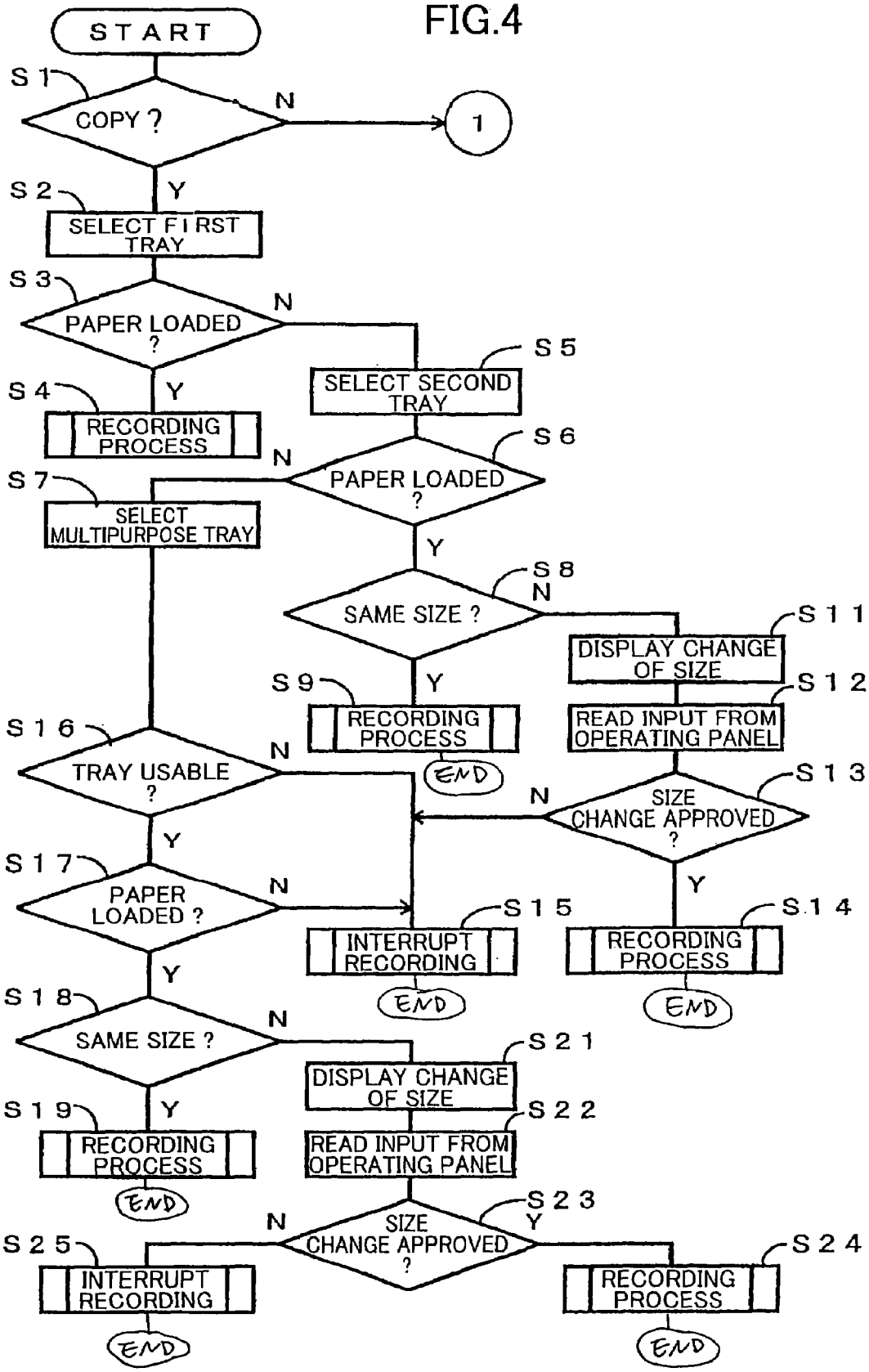
FIG. 4 is a flowchart representing first part of a main process executed in the multifunction device.
Figure 5:
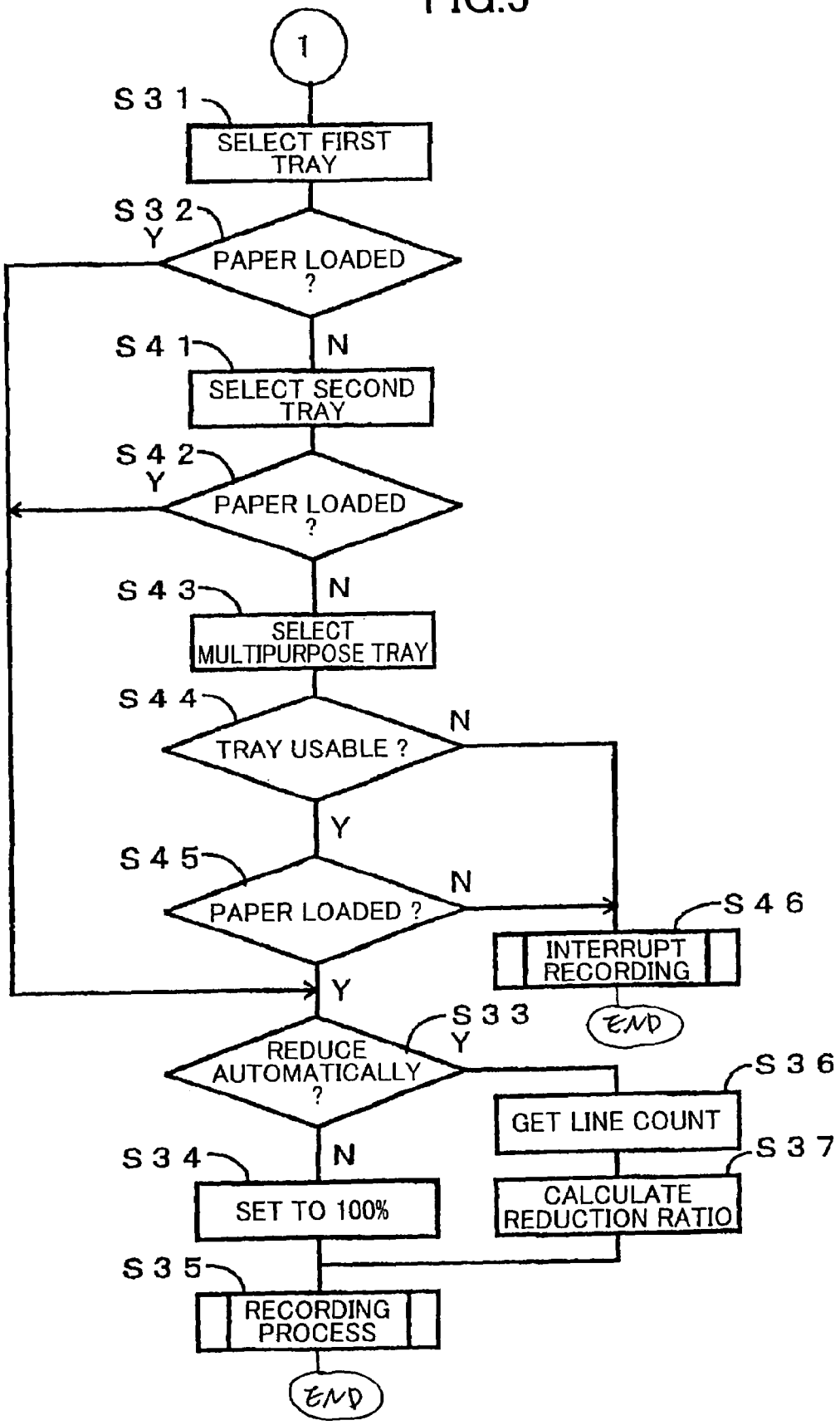
FIG. 5 is a flowchart representing a remaining part of the main process.

As shown in FIG. 4, when the process starts, the CPU 11 first determines in S1 whether or not a process specified by the printing command is the photocopier operation. If so (S1: YES), the CPU 11 selects in S2 the first tray 61 and then determines in S3, based on the output signal from the paper detection sensor 71, whether or not a recording sheet P is loaded in the first tray 61. If a recording sheet P is loaded (S3: YES), a well-known printing process is executed in S4 so as to copy an image of the original to the recording sheet P supplied from the first tray 61. Then, the process ends.

On the other hand, if there is no recording sheet P in the first tray 61 (S3: NO), the second tray 62 is selected in S5, and it is determined in S6 whether there is a recording sheet P in the second tray 62 based on the output signal from the paper detection sensor 72. If it is determined in S6 that there is no recording sheet P in the second tray 62 (S6: NO), then the process proceeds to S7. If it is determined in S6 that there is a recording sheet P in the second tray 62 (S6: YES), then the process proceeds to S8.

In S8, it is determined whether or not the recording sheet P loaded in the second tray 62 is the same size as the recording sheet for the first tray 61 based on the correlation data stored in the memory 14*b*. If so (S8: YES), then the printing process is executed in S9, in a similar manner as in S4, so as to copy an image of the original to the recording sheet P supplied from the second tray 62. Then, the process ends.

If the recording sheet P in the second tray 62 is not the same size as the recording sheet for the first tray 61 (S8: NO), then in S11, a message indicating that the size will change is displayed on the display 3*a* of the operating panel 3. More specifically, in S11, the size of the recording sheet P loaded in the second tray 62 is displayed on the display 3*a* based on the correlation data stored in the memory 14*b*, asking the user if the document can be copied using the recording sheet stored in the second tray 62 instead of the recording sheet supplied from the first tray 61. In S12, input from the operating panel 3 is read until the keyboard 3*b* is operated to approve or reject the size change. After the keyboard 3*b* is operated to approve or reject the size change in S12, the process proceeds to S13.

In S13, it is determined whether the operation denotes approval or not. If so (S13: YES), then in S14, the printing process is executed in a similar manner as in S4 so as to copy an image of the original to the recording sheet P supplied from the second tray 62. Then, the process ends. On the other hand, if not (S13: NO), then in S15, an interrupt process is executed to, for example, display an error message on the display 13*a* and to restore the multifunction device 1 to the initial settings. Then, the process ends.

If it is determined in S6 that there is no recording sheet P in the second tray 62 (S6: NO), then in S7, the multipurpose tray 63 is selected, and it is determined in S16 whether or not the multipurpose tray 63 can be used. Here, as mentioned above, the memory 14*b* is not provided with an area for storing the size of recording sheets P loaded in the multipurpose tray 63. Using the multipurpose tray 63 may therefore not be allowed depending upon the operating mode of the multifunction device 1. In this embodiment, the multipurpose tray 63 can be used in the photocopier mode, and a positive determination is made in S16 (S16: YES). Then, the process proceeds to S17.

In S17, it is determined whether or not a recording sheet P is loaded in the multipurpose tray 63 based on the output signal from the paper detection sensor 73. If no recording sheet P is loaded (S17: NO), then the process proceeds to S15. On the other hand, if so (S17: YES), then in S18, it is determined whether or not the recording sheet P loaded in the multipurpose tray 63 is the same size as the recording sheet P for the first tray 61. If so (S18: YES), then in S19, the printing process is executed so as to copy an image of the original to the recording sheet P supplied from the multipurpose tray 63. Then, the process ends.

However, because as mentioned above the size of recording sheets P loaded in the multipurpose tray 63 is not stored in the memory 14*b*, a negative determination is made in S18 in this embodiment (S18: NO), and the process proceeds to S21. In S21, a prompt indicating that copying will be performed using an unknown size of recording sheet P is displayed on the display 3*a*. As in S12 through to S15 described above, after the user input through the keyboard 3*b* denoting approval or rejection in S22, it is determined in S23 whether or not approval is indicated. If so (S23: YES), the printing process is executed in S24 so as to perform copying operation, and the process ends. On the other hand, if rejection is indicated (S23: NO), the interrupt process is executed in S25, and the process ends.

It should be noted that if facsimile data is received while executing the printing process (S1 through S25), the printing process continues, and the facsimile data is stored into the RAM 14.

As described above, when there is no recording sheet P in the first tray 61 (S3: NO), the second tray 62 is selected. Also, when there is no recording sheet P in the second tray (S6: NO), then the multipurpose tray 63 is selected. If the size of recording sheet P stored in the alternately selected second tray 62 differs from the size of recording sheets for the first tray 61, then the user is notified. Also, because the correlation data for the multipurpose tray 63 is not stored, when the multipurpose tray 63 is alternately selected, the user is notified also. Then, only if the user then approves the alternate sheet selection, recording sheet P is supplied for the photocopier operation from the second tray 62 or the multipurpose tray 63. That is, it is determined whether the recording sheet P stored in the alternately selected tray can be substituted when there is no recording sheet P in the initially selected first tray 61, and the printing process is executed after appropriately selecting a tray that holds the substitutable recording sheet.

If the CPU 11 determines in S1 that the printing command input to the multifunction device 1 does not indicate the photocopier operation, that is, if the printing command indicates a facsimile reception operation, a printer operation, or other non-photocopier operation (S1: NO), then the process proceeds to S31.

In S31, the first tray 61 is selected, and in S32, it is determined whether or not there is any recording sheet P in the first tray 61. If so (S32: YES), then in S33, it is detected whether or not an auto-reduction mode is being selected. Here, the auto-reduction mode is selected by a user through operation on the operating panel 3. If not (S33: NO), then in S34, a size ratio is set to 100% , and printing process is executed in S35 so as to print image data received from the telephone line 7 or the personal computer 8 onto the recording sheet P. Then, the process ends.

If it is determined in S33 that the auto-reduction is being selected (S33: YES), then in S36, the line count of the image data is acquired. The ratio corresponding to the size of the recording sheet P is calculated in S37 based on the retrieved line count, and the printing process is executed in S35 using the calculated ratio. That is, if auto-reduction is enabled (S33: YES), an image corresponding to the image data is printed in a reduced size so that the entire image is formed on a recording sheet even if the size of the recording sheet supplied for printing is smaller than the size of recording sheet corresponding to the received image data.

If there is no recording sheet P in the first tray 61 (S32: NO), then in S41, the second tray 62 is selected, and in S42, it is determined whether or not there is any recording sheet P in the second tray 62. If there is a recording sheet P in the second tray 62 (S42: YES), then the process proceeds to S33.

On the other hand, if there is no recording sheet P in the second tray 62 (S42: NO), then the multipurpose tray 63 is selected in S43, and it is determined in S44 whether or not the multipurpose tray 63 is usable. Here, as mentioned above, the size of recording sheet P loaded in the multipurpose tray 63 is not stored in the memory 14*b*. In this embodiment, using the multipurpose tray 63 is therefore not permitted in the facsimile receiving mode. However, using the multipurpose tray 63 can be permitted in the printer mode depending on the settings from the personal computer 8.

If it is determined in S44 that the multipurpose tray 63 is usable (S44: YES), then in S45 it is determined whether or not there is any recording sheet P in the multipurpose tray 63. If there is a recording sheet P in the multipurpose tray 63 (S45: YES), then the process proceeds to S33.

On the other hand, if it is determined in S44 that the multipurpose tray 63 is not usable (S44: NO), or if it is determined that there is no recording sheet P in the multipurpose tray 63 (S45: NO), then the process proceeds to S46. In S46, an interrupt process is executed, and then the process ends. In the interrupt process, the personal computer 8 or the facsimile machine that has sent the image data is notified that the image data was not printed.

As described above, in the facsimile reception mode or the printer mode, the printing process is executed (S35) using recording sheet in the second tray 62 or the multipurpose tray 63 without requesting user approval if there is no recording sheet in the first tray 61. Therefore, received image data is prevented from being lost without being printed.

If auto-reduction is enabled (S33: YES) and if the size of the recording sheet supplied for printing is smaller than the size of recording sheet corresponding to the received image data, then an image is printed in a reduced size in accordance with the difference between the size of actual recording sheet and the required size so that the entire image is formed on a recording sheet without loosing any part of the image.

The above-described multifunction device 1 receives facsimile data from the telephone line 7 by the NCU 25, and image data from the computer 8 by the Centronics interface 27. If the image corresponding to the facsimile data from the telephone line 7 is formed on a recording sheet stored in the multipurpose tray 63, for which the loaded sheet size is not stored in the memory 14*b*, there is no assurance that the entire image will be formed on the recording sheet. Further, if part of the image is not formed, it may not be possible to subsequently reprint and see the part of the image. However, in the present embodiment, a tray other than the multipurpose tray 63 is selected in the facsimile receiving mode (S44). That is, a tray other than the multipurpose tray 63 is selected when forming an image based on image data received by the NCU 25. Therefore, entire image can be printed based on image data received over the telephone line 7 without loosing any part of the image.

The user can be assumed to be relatively near the multifunction device 1 when using the photocopier function and can therefore appropriately approve using a different sheet size. The present invention therefore supplies recording sheet P stored in the alternately selected tray for printing in the photocopier mode only if the user approves using that recording sheet when sheet size does not match.

However, the user is not necessarily near the multifunction device 1 when using the facsimile function or the printer function, and the user may therefore be unable to respond to any prompt. Also, storing the received image data in the RAM 14 until the user can respond may also not be possible. The present invention therefore supplies recording sheet P stored in the alternately selected tray for printing regardless of whether the user approves or not. User permission can therefore be used more rationally, and loss of received image data without being supplied to the printing process can be better prevented.

Recreating image data (facsimile data) received over the telephone line 7 is difficult once it has been lost, but image data supplied from the external computer 8 without using the telephone line 7 can be reproduced relatively easily because the user of the external computer 8 and the user of the multifunction device 1 are often the same. In addition, when the user of the external computer 8 and the user of the multifunction device 1 are the same, the user usually knows what size of recording sheet P is loaded in the multipurpose tray 63.

That is, when part of an image is not formed on a recording sheet, the ease of recreating the image differs in the photocopier mode and in the facsimile receiving and printer modes. Therefore, by controlling a printing mechanism (printer engine 4) and a sheet supply unit (rollers 61*a*, 62*a*, 63*a*) differently in each of these cases when there is no recording sheet in the selected tray, the present invention assures appropriate printing whenever there is no recording sheet in the selected tray.

Because the multifunction device 1 is provided with the tray 63 for which the size of loaded recording sheet is not stored in the memory 14*b*, the convenience of the device 1 is improved.

The size of recording sheet P stored in each tray 61, 62 is extremely meaningful for determining if the tray 61, 62 substitution is possible. Because the correlation between the trays 61, 62 and the size of recording sheet stored in each tray 61, 62 is stored in the memory 14*b*, the user can be notified of the size of recording sheet stored in the alternately selected tray 62, and the user can accurately determine whether the tray 62 can be substituted. In this manner, a substitutable tray can be more appropriately selected for printing.

Because the correlation between the size of recording sheet and the first tray 61 and the second tray 62 is input from the operating panel 3 and stored into the memory 14*b*, it is not necessary to provide sensors for detecting the size of recording sheet to the trays 61, 62. Therefore, the configuration of the multifunction device 1 is simplified, and the cost can be reduced. Furthermore, any size of recording sheet can be stored in any tray. The most frequently used recording sheet can therefore be replenished more easily because, for example, the most frequently used size of recording sheet can be loaded in the tray that is easy to refill.

While some exemplary embodiments of this invention have been described in detail, those skilled in the art will recognize that there are many possible modifications and variations which may be made in these exemplary embodiments while yet retaining many of the novel features and advantages of the invention.

For example, the present invention can be applied to devices other than multifunction devices, including, an image forming device having only a photocopier function.

In the above-described embodiment, the correlation between the first tray 61, the second tray 62, and the size of recording sheet P is input from the operating panel 3 and stored into the memory 14*b*. However, the correlation can be fixed to preset values, or input automatically by sensors provided to the first tray 61 and the second tray 62.

The correlation shall also not be limited to the size of recording sheet, and could store the type of recording sheet, such as bond paper, special purpose paper, or OHP film, or the type of recording sheet as determined by paper thickness. In this case, it can be more accurately determined if substitution is possible.

In the above-described embodiment, the trays are selected in the order first tray 61, second tray 62, and multipurpose tray 63. However, in the printing mode, the trays could be selected in the order multipurpose tray 63, first tray 61, second tray 62 in accordance with input from the personal computer 8. As mentioned above, the user of the computer 8 and the user of the multifunction device 1 are often the same, and the user therefore often knows which tray should be selected first when printing image data sent from the computer 8. If the user can set the tray selection order in such cases, the tray preferred for use in printing and the trays that can be substituted can be more appropriately selected for printing.

Furthermore, processes comparable to the processes in S11, S12, S21, and S22 and be executed on the personal computer 8 side in the printer mode.

In the photocopying operation, the document size could also be detected by sensors, and recording sheet could be selected from the size closest to the detected document size.

The present invention can also be applied to an image forming device having a manual insertion tray holding only one sheet of recording sheet instead of the multipurpose tray 63, and to an inkjet or ink ribbon type image forming device.

Furthermore, instead of disposing a sheet detection sensor to each tray, the presence of recording sheet in each tray could be determined by detecting whether the output signal from the sheet detection sensor disposed on the sheet transportation path goes to a sheet-detected state within a specified time after the feed roller is driven.

What is claimed is:

1. An image forming device comprising:

a printing unit that forms an image on a recording medium;

a plurality of trays, each supporting a recording medium;

a selection unit that selects one of the plurality of trays;

a supply unit that supplies a recording medium from the selected one of the plurality of trays to the printing unit;

a detecting unit that detects whether the selected one of the plurality of trays is empty;

a controller that instructs the selection unit to reselect a different one of the plurality of trays when the detecting unit detects that the selected one of the plurality of trays is empty;

a determining unit that determines whether one or more of size and type of recording medium for the selected one of the plurality of trays differs from one or more of size and type of recording medium stored in the selected different one of the plurality of trays;

a notifying unit that notifies a user of information relating to the selected different one of the plurality of trays when the determining unit determines that one or more of size and type of recording medium for the selected one of the plurality of trays differs from one or more of size and type of recording medium stored in the selected different one of the plurality of trays;

an input unit through which an approval is input, the approval approving using the selected different one of the plurality of trays; and a scanning unit that reads document image from a document and a receiving unit that receives image data, wherein when the approval is input, the supply unit supplies the recording medium from the selected different one of the plurality of trays to the printing unit, when printing based on the document image is instructed, the supply unit supplies the recording medium from the selected different one of the plurality of trays to the printing unit only if the approval is input through the input unit, and when printing based on image data received by the receiving unit is instructed, the supply unit supplies the recording medium from the selected different one of the trays to the printing unit irrespective of whether the approval is input.

2. The image forming device according to claim 1, further comprising a memory that stores a correlation between each one of the plurality of trays and one or more of the size and the type of recording medium for the corresponding one of the plurality of trays.

3. The image forming device according to claim 2, wherein the correlation is input through the input unit.

4. The image forming device according to claim 2, wherein when the printing unit forms an image based on image data received by the receiving unit, if the size of the recording medium stored in the selected one of the plurality of trays is smaller than the size of recording medium specified by the image data, the printing unit forms the image in a reduced size according to the size difference.

5. The image forming device according to claim 2, wherein the receiving unit includes a first receiving unit that receives image data via a public communication line and a second receiving unit that receives image data from an external computer not via the public communication line;

at least one of the plurality of trays is a special tray;

a correlation between the special tray and the size of recording medium for the special tray is not stored in the memory; and the selection unit selects one of the plurality of trays other than the special tray when the printing unit forms an image based on image data received by the first receiving unit.

6. The image forming device according to claim 2, further comprising a selection order setting unit that sets an order in which the selection unit selects the trays, wherein the receiving unit includes a first receiving unit that receives image data via a public communication line and a second receiving unit that receives image data from an external computer not via the public communication line, and the selecting order setting unit sets the order for when the printing unit forms an image based on image data received by the second receiving unit.

7. An image forming device comprising:

a printing unit that forms an image on a recording medium;

a plurality of trays, each holding a recording medium;

a selection unit that selects one of the plurality of trays;

a supply unit that supplies a recording medium from the selected one of the plurality of trays to the printing unit;

a scanning unit that reads a document image from a document;

a receiving unit that receives image data;

a detecting unit that detects whether the selected one of the plurality of trays is empty; and a controller that controls the printing unit and the supply unit, wherein when the detecting unit detects that the selected one of the plurality of trays is empty, the controller controls one or more of the printing unit and the supply unit in a first mode when the printing unit forms an image based on the document image read by the scanning unit, and the controller controls one or more of the printing unit and the supply unit in a second mode when the printing unit forms an image based on the image data received by the receiving unit.

8. The image forming device according to claim 7, wherein the controller instructs the selection unit to reselect a different one of the plurality of trays when the detecting unit detects the selected one of the plurality of trays; and the controller controls one or more of the printing unit and the supply unit in the second mode such that the supply unit supplies the recording medium from the selected different one of the trays to the printing unit when printing based on the image data received by the receiving unit is instructed.

* * * * *